313-414 3R
3/27/84 OR 4,439,710

United States Patent [19]
Osakabe et al.

[11] 4,439,710
[45] Mar. 27, 1984

[54] ELECTROMAGNETIC FOCUSING CATHODE-RAY TUBE

[75] Inventors: Kuniharu Osakabe; Isao Yoshimi, both of Mobara; Kyohei Fukuda, Fujisawa, all of Japan

[73] Assignee: Hitachi, Ltd., Tokyo, Japan

[21] Appl. No.: 279,598

[22] Filed: Jul. 1, 1981

[30] Foreign Application Priority Data

Jul. 2, 1980 [JP] Japan ..... 55-89215
Jul. 2, 1980 [JP] Japan ..... 55-89216

[51] Int. Cl.[3] ..... H01J 29/64
[52] U.S. Cl. ..... 313/414; 313/443
[58] Field of Search ..... 313/442, 443, 414

[56] References Cited

U.S. PATENT DOCUMENTS 2,149,101 2/1939 Ploke ..... 313/443
2,785,330 3/1957 Fogelberg et al. ..... 313/443
4,362,964 12/1982 Sakurai et al. ..... 313/414

FOREIGN PATENT DOCUMENTS 50-26274 8/1975 Japan ..... 313/443
55-39121 3/1980 Japan ..... 313/443
55-43758 3/1980 Japan ..... 313/414
55-59637 5/1980 Japan ..... 313/414

*Primary Examiner*—Palmer C. Demeo
*Attorney, Agent, or Firm*—Antonelli, Terry & Wands

[57] ABSTRACT

An electromagnetic focusing cathode-ray tube in which plural pairs of magnetic material members are arranged within the tube along the tube axis, the magnetic material members in each pair are disposed to oppose each other in the direction of the tube axis with a gap defined therebetween, and the plural magnetic material member pairs and one or more permanent magnet disposed internally or externally of the tube are combined such that magnetic focusing fields having their senses or directions opposite to each other in the direction of the tube axis are formed at the respective gaps associated with the adjacent magnetic material pairs.

15 Claims, 17 Drawing Figures

ELECTROMAGNETIC FOCUSING CATHODE-RAY TUBE

The present invention relates to an improvement in an electromagnetic focusing cathode-ray tube, and more particularly to an improvement in its convergence characteristic and its focusing characteristic.

FIG. 1 shows a sectional view of a principal portion of a conventional typical in-line gun and outer magnet type electromagnetic focusing cathode-ray tube having three election guns aligned in a line and a cylindrical permanent magnet arranged on an outer circumference of a neck portion of the tube, FIG. 2*a* shows a sectional view taken along a plane normal to that of FIG. 1 and FIG. 2*b* shows a sectional view taken along line II-*b*—II*b* in FIG. 1.

In those figures, numeral 1 denotes a tube bulb, numeral 2 cathodes, numeal 3 a first grid electrode, numeral 4 a second grid electrode, numeral 5 a third grid electrode, numeral 6 a pair of magnetic yokes made of high permeability magnetic material such as soft steel containing very low carbon, numeral 6*a* the magnetic yoke positioned at the side at the cathodes 2, numeral 6*b* the magnetic yoke positioned at the side at a phosphor screen (not shown), and numeral 8 an inner conductive layer deposited on an inner wall of the bulb 1. The conductive layer 8 and the magnetic yoke 6*b* are electrically connected through conductive strips 7. Numeral 9 denotes a cylindrical permanent magnet arranged externally of the tube at a position corresponding to a gap 6*g* defined between the magnetic yokes 6*a* and 6*b*. Numeral 10 denotes a plurality of stem leads which are respectively connected with the electrodes in the bulb 1 although the connection is not shown. Numeral 11 denotes electrode supporting studs which are usually made of glass, numeral 12*b*, a center electron beam, and numerals 12*a* and 12*c* side electron beams. Numerals 14*a*, 14*b* and 14*c* denote beam permeable apertures formed in the magnetic yokes 6*a* and 6*b*, and numeral 16 members usually made of ferromagnetic material. The magnetic yokes 6*a* and 6*b* are coupled by non-magnetic metal strip means (not shown).

In the electromagnetic focusing cathode-ray tube thus constructed, each of the three electron beams 12*a*, 12*b* and 12*c* emitted from the cathodes 2 passes through the first grid electrode 3 and the second grid electrode 4 and it is focused to form a crossover which is substantially an image of the associated cathode. Thereafter each beam is accelerated by an anode potential applied to the conductive layer 8 and passes through a prefocusing electron lens 13 formed by the second grid electrode 4 and the third grid electrode 5 and then passes through a main focusing magnetic lens 15 formed in the gap 6*g* between the paired magnetic yokes 6*a* and 6*b*, and finally reaches the phosphor screen.

The paired magnetic yokes 6*a* and 6*b* absorb the magnetic fluxes generated inwardly from the cylindrical permanent magnet 9 which is magnetized in a direction of the tube axis such that the yoke 6*a* is equivalently magnetized in an S pole while the yoke 6*b* is equivalently magnetized in an N pole. As a result, a magnetic focusing field shown by broken lines in FIG. 2*c* is formed in and around small cylinders defined in the gap 6*g* by the apertures 14*a*, 14*b* and 14*c* of the magnetic yokes 6*a* and 6*b*. The permanent magnet 9 is arranged to keep a predetermined relation to the gap 6*g* of the paired magnetic yokes 6*a* and 6*b* so that the magnetic focusing field is uniformly distributed.

As a result, the electron beams 12*a*, 12*b* and 12*c* passed through the paired magnetic yokes 6*a* and 6*b* are focused in a manner shown in FIG. 2*c* so that they form crossover image points on the phosphor screen and the three electron beams 12*a*, 12*b* and 12*c* converge at one location on the phosphor screen (static convergence).

However, in the electromagnetic focusing cathode-ray tube of the type described above, since the focusing magnetic field is not localized only in the gap 6*g* between the magnetic yokes 6*a* and 6*b*, leakage magnetic fields are generated around the yoke assembly 6 facing the cathode and the phosphor screen, which adversely affects the static convergence characteristic and a shape of beam spot resulting in deterioration of a resulting picture image and interacts with a magnetic deflecting field generated by deflecting means (not shown) to rotate an image area or imaged picture on the phosphor screen. More specifically, for the magnetic field generated only by the permanent magnet 9, a magnetic field component $B_Z$ in a direction of the tube axis must meet the following equation:

$$\int_{-\infty}^{\infty} B_Z dZ = 0.$$

According to an experiment made by the present inventors, the axial magnetic field component $B_Z$ distributes as shown in FIG. 3, in which a distribution shown by a curve I*a* is that of the magnetic focusing field generated in the gap 6*g* between the magnetic yokes 6*a* and 6*b* and distributions shown by curves I*b* and I*c* are those of the leakage magnetic fields present on the cathode side and the phosphor screen side. By the nature of the magnetic field defined by the above equation, it is almost impossible to reduce only the leakage magnetic fields. The leakage magnetic field present on the cathode side acts on the electron beam emitted from the cathode 2 toward the phosphor screen to create a Lorentz's force normal to the axis of the tube so that the loci of the side beams 12*a* and 12*c* deviate away from their center axes, resulting in a coma aberration which significantly deteriorates the focusing characteristic. On the other hand, the leakage magnetic flux on the phosphor screen side deteriorates the orthogonality on the screen and the convergence characteristic.

In addition, in the electromagnetic focusing cathode-ray tube of the type described above, if the permanent magnet is slightly displaced in a direction of the tube axis, the magnetic fluxes in the gap 6*g* between the yokes 6*a* and 6*b* are not parallel to the tube axis so that magnetic field components normal to the side beams 12*a* and 12*c* are created causing the static convergence to be significantly varied vertically.

It is an object of the present invention to provide an electromagnetic focusing cathode-ray tube which minimizes the generation of the leakage magnetic fields in order to overcome the problems caused by the leakage magnetic fields.

According to the present invention, there is provided an electromagnetic focusing cathode ray-tube comprising an electron gun assembly and a magnetic focusing field forming means including in combination a permanent magnet member and a magnetic material assembly disposed on one side of said electron gun assembly within the tube, the magnetic material assembly having a plurality of electron beam permeable apertures each extending in a direction of the tube axis, wherein the magnetic material assembly includes plural pairs of magnetic material members, the magnetic material members in each pair being disposed to oppose to each other in the direction of the tube axis with a gap defined therebetween, and the permanent magnetic member and the plural pairs of magnetic material members being arranged so that magnetic focusing fields having their senses reverse to each other in the direction of the tube axis are formed in the respective gaps associated with adjacent ones of said magnetic material member pairs.

The present invention will now be described by means of preferred embodiments in conjunction with the accompanying drawings, in which:

FIG. 1 shows a sectional view of a principal portion of a conventional typical in-line gun and outer magnet type electromagnetic focusing cathode-ray tube;

FIG. 2*a* shows a sectional view taken along a plane normal to that of FIG. 1;

FIG. 2*b* shows a sectional view taken along line II-*b*—II*b* in FIG. 1;

FIG. 2*c* shows a portion of the sectional view shown in FIG. 1 for illustrating an electron beam focusing function;

Figure 10:
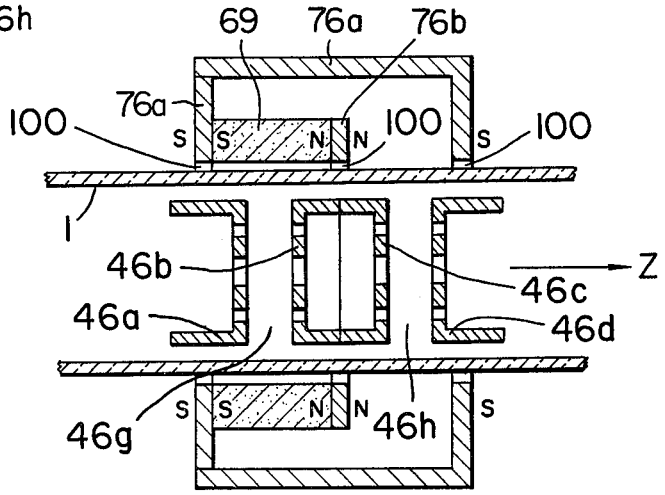
FIG. 10 shows a sectional view of a principal portion of an electromagnetic focusing cathode-ray tube according to a further embodiment of the present invention, which shows a permanent magnet member for an outer magnet type.
Figure 11:
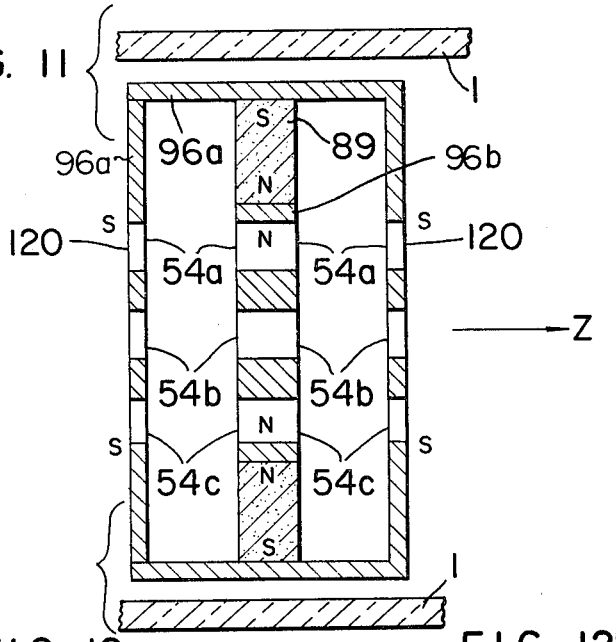
FIG. 11 shows a sectional view of a principal portion of an electromagnetic focusing cathode-ray tube according to a still further embodiment of the present invention, which shows a permanent magnet member and magnetic yoke combination for an inner magnet type.
Figure 12A:
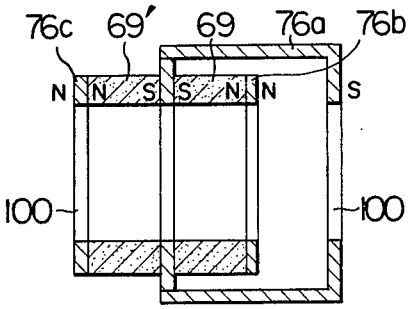
Figure 12B:
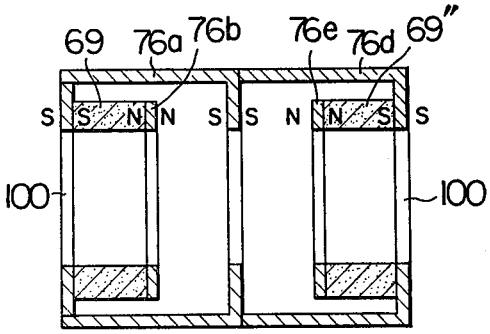
Figure 13A:
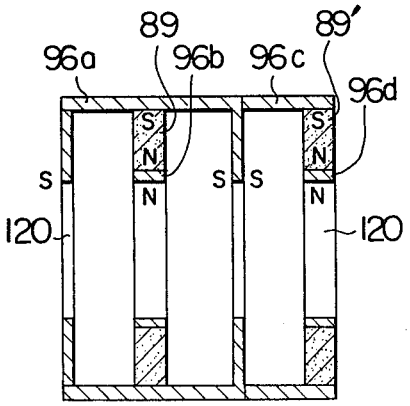
Figure 13B:
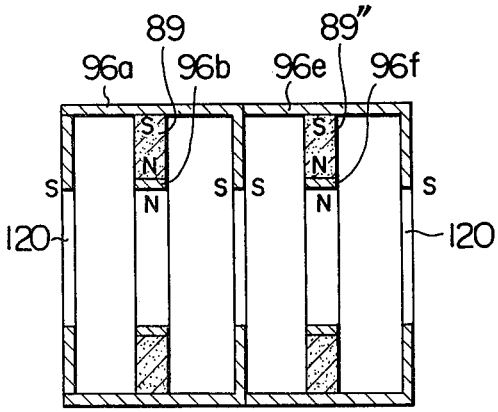

FIGS. 12*a* and 12*b* show modifications of the embodiment of FIG. 10; and FIGS. 13*a* and 13*b* show modifications of the embodiment of FIG. 11.

Figure 1:
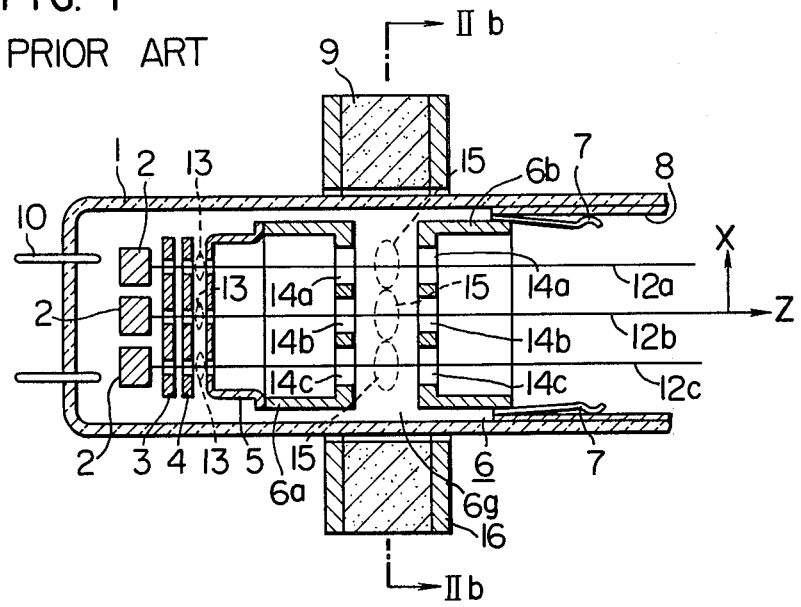
FIG. 1 PRIOR ART
Figure 2A:
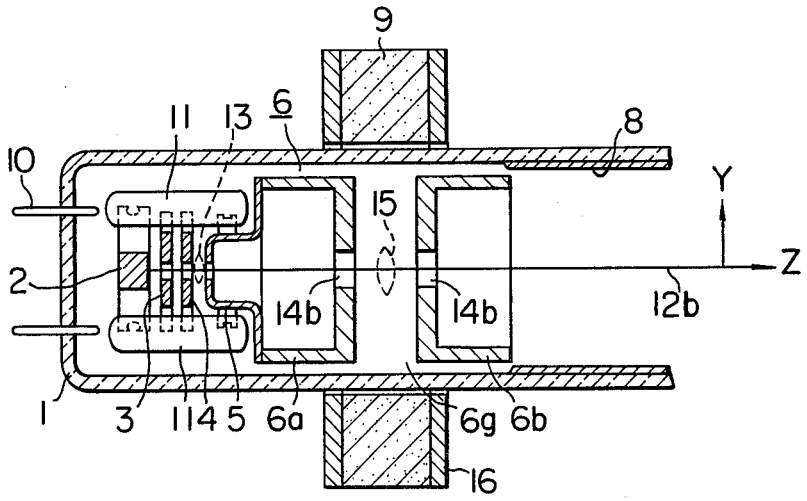
FIG. 2a PRIOR ART
Figure 2B:
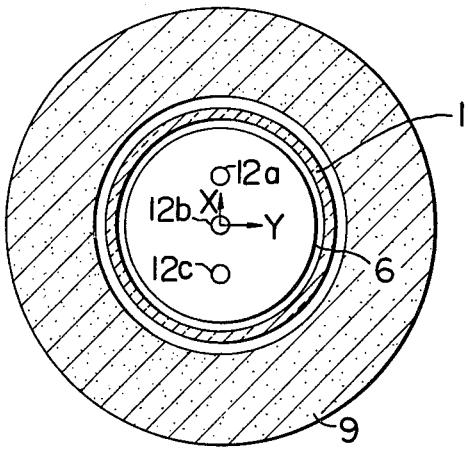
FIG. 2b PRIOR ART
Figure 2C:
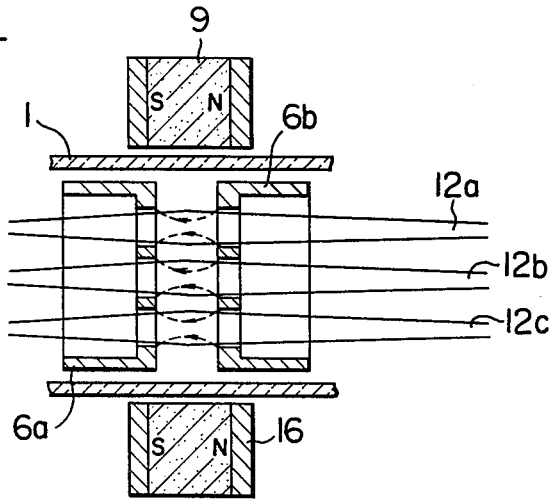
FIG. 2c PRIOR ART
Figure 3:
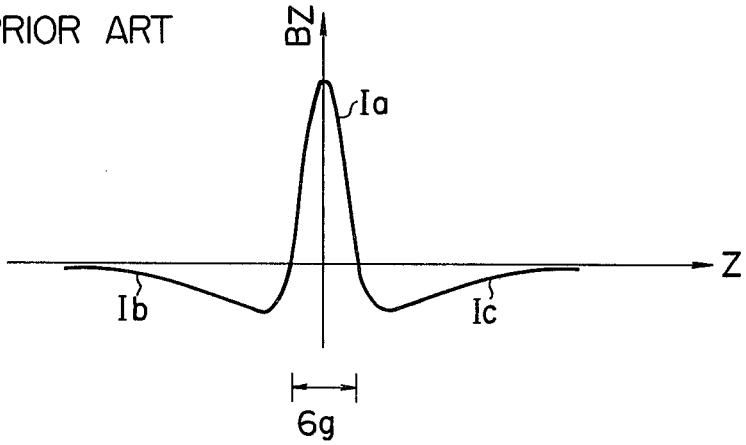
FIG. 3 PRIOR ART
FIG. 3 shows a graph illustrating an experimental data of a magnetic field component $B_Z$ along a tube axis in the structure shown in FIG. 1.
Figure 4:
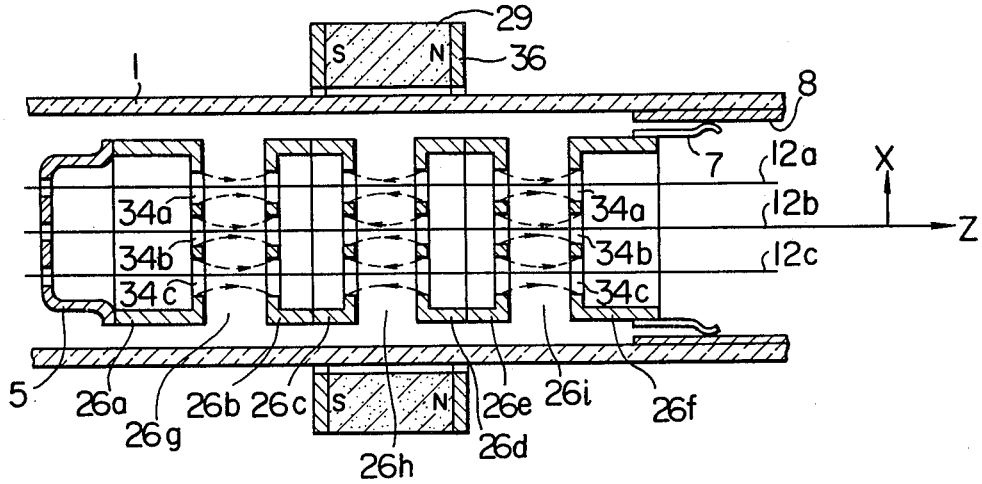
FIG. 4 shows a sectional view of a principal portion of an outer magnet electromagnetic focusing cathode-ray tube according to one embodiment of the present invention.

FIG. 4 shows a sectional view of a principal portion of an electromagnetic focusing cathode-ray tube according to one embodiment of the present invention, in which the like elements to those shown in FIG. 1 are designated with like numerals and they are not explained here in detail. In FIG. 4, three pairs of magnetic yokes 26*a*, 26*b*; 26*c*, 26*d*; and 26*e*, 26*f* are arranged in a direction of the tube axis, and a gap 26*g* is defined between the paired opposing yokes 26*a* and 26*b*, a gap 26*h* is defined between the paired opposing yokes 26*c* and 26*d* and a gap 26*i* is defined between the paired opposing yokes 26*e* and 26*f*. The yokes are made of the material substantially identical to that of the yokes 6*a* and 6*b* explained in FIG. 1 and have appropriate sizes and shapes. The yoke 26*a* is directly coupled to the third grid electrode, and the yokes 26*b* and 26*c* and the yokes 26*d* and 26*e* are directly coupled to each other, respectively. The yokes 26*a*, 26*b*; 26*c*, 26*d*; and 26*e*, 26*f* are connected with each other by non-magnetic metal strips (not shown), respectively. Each of the yokes has beam permeable apertures 34*a*, 34*b* and 34*c* for the three electron beams 12*a*, 12*b* and 12*c*.

On an outer surface of the bulb 1 at a position corresponding to a center between the second paired magnetic yokes 26*c* and 26*d*, a cylindrical permanent magnet 29 magnetized in the direction of the tube axis is arranged with a center axis aligned with the tube axis. The dimensions of the permanent magnet 29 are determined such that the magnetic fluxes emanated inwardly are absorbed by the respective magnetic yokes so that the magnetic focusing fields formed in the gaps 26*h* and 26*g* or 26*h* and 26*i* have their senses (directions) reverse or opposite to each other in the direction of the tube axis as shown by broken lines in FIG. 4. The permanent magnet 29 is held by ring-shaped magnetic material members 36 usually made of ferromagnetic material.

Exemplifing typical dimensions, the magnet 29 may have a thickness of about 10 mm, an inner diameter of 30–50 mm and an outer diameter of 40–60 mm. Each of the yokes 26*a*–26*f* may have an outer diameter of 15.6 mm and the apertures 34*a*–34*c* each of which has its diameter of 3–6 mm. The yoke thickness of 0.6–1.5 mm, each yoke height of 4–10 mm and each gap distance of 5–9 mm may be properly combined.

Figure 5:
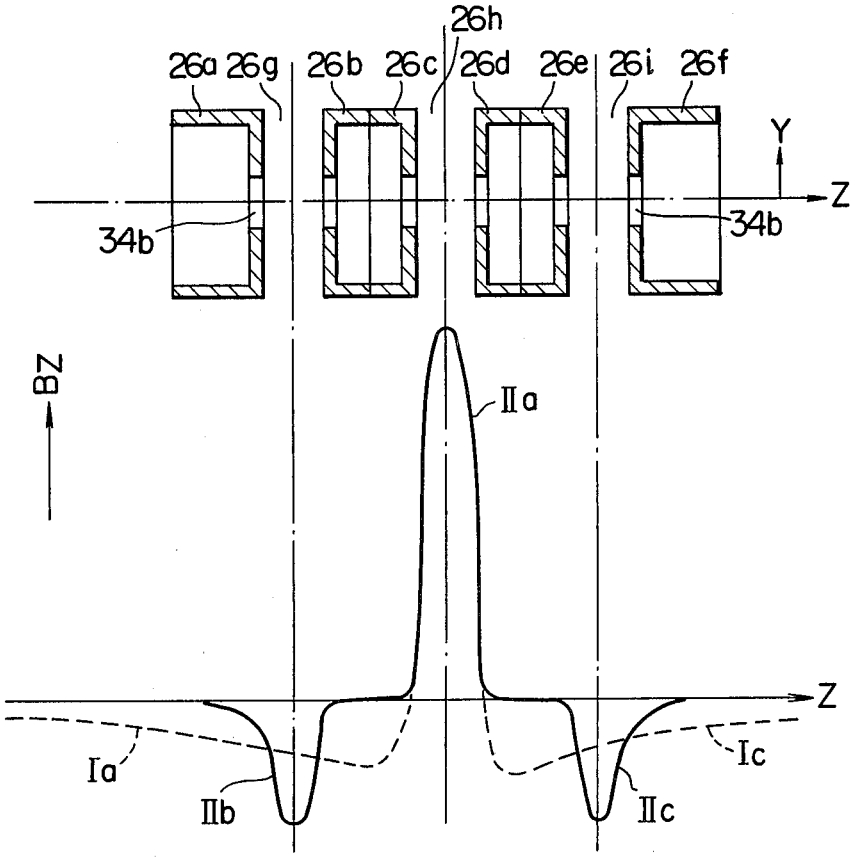
FIG. 5 illustrates a relationship between a magnetic yoke arrangement and a distribution of the magnetic field component $B_Z$ in the embodiment of FIG. 4.

With the structure described above, the magnetic field component $B_Z$ distributes among the magnetic yokes 26*a*–26*f* in a distribution shown in FIG. 5. More specifically, a magnetic focusing field shown by a curve II*a* is produced in the gap 26*h* between the paired magnetic yokes 26*c* and 26*d* having the permanent magnet 29 centrally disposed and magnetic focusing fields shown by curves II*b* and II*c* are created in the gap 26*g* between the paired magnetic yokes 26*a* and 26*b* and the gap 26*i* between the paired magnetic yokes 26*e* and 26*f*, respectively. The leakage magnetic fields shown by the leakage magnetic flux distribution curves I*b* and I*c* shown by broken lines in FIG. 5, which were present in the prior art structure, are localized in the gap 6*g* between the magnetic yokes 6*a* and 6*b* and the gap 6*i* between the magnetic yokes 6*e* and 6*f*, respectively, and altered to the magnetic focusing fields shown by curves II*b* and II*c*. As a result, focusing magnetic lenses are formed in the gaps 26*g*, 26*h* and 26*i* of the three pairs of the magnetic yokes 26*a*, 26*b*; 26*c*, 26*d*; and 26*e*, 26*f*, and hence the focusing characteristics is greatly enhanced. In addition, since no substantial leakage magnetic field is produced on the cathode side of the yoke 26*a* and the phosphor screen side of the yoke 26*f*, the deterioration of the deflection characteristic and the convergence characteristic due to the leakage magnetic field is substantially suppressed. Furthermore, since the magnetic focusing field is effectively produced without forming the leakage magnetic field, a smaller and lighter permanent magnet than the prior art permanent magnet can be used to produce the same strength of effective magnetic focusing field.

While three pairs of magnetic yokes are shown in the illustrated embodiment, similar effect can be attained by two or more pairs of magnetic yokes. When even pairs of magnetic yokes are used, for example, only the yokes 26a–26d or the yokes 26c–26f in FIG. 4 are used, the leakage magnetic field remains on either the phosphor screen side or the cathode side but the leakage magnetic field is not produced on the other side. Accordingly, the characteristics can be improved even in this case.

Figure 6:
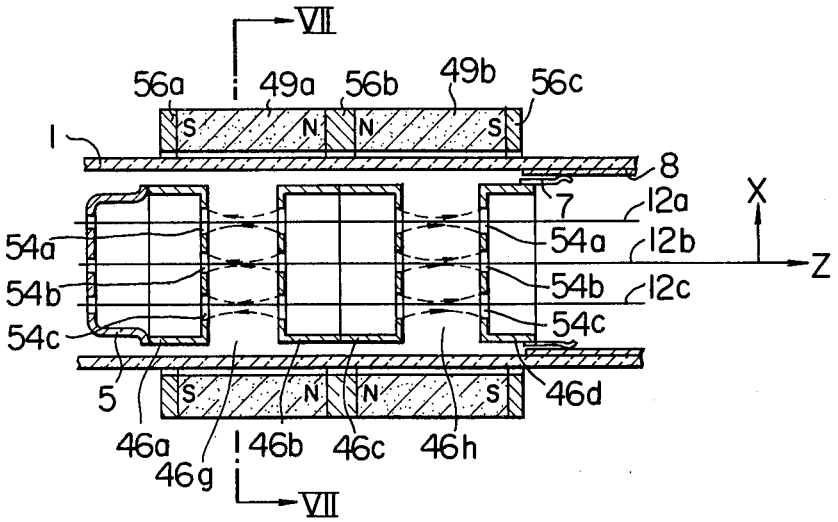
FIG. 6 shows a sectional view of a principal portion of an outer magnet electromagnetic focusing cathode-ray tube according to another embodiment of the present invention.
Figure 7:
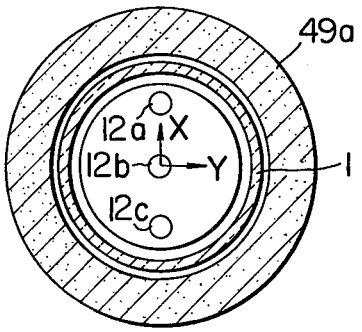
FIG. 7 shows a sectional view taken along line VII—VII in FIG. 6.

FIGS. 6 and 7 show sectional views of principal portions of an electromagnetic focusing cathode-ray tube according to another embodiment of the present invention, in which two pairs of magnetic yokes 46a, 46b and 46c, 46d are arranged in a direction of the tube axis and two cylindrical permanent magnets 49a and 49b are arranged on an outer circumference of a neck portion of the bulb 1 at positions corresponding to a gap 46g between the paired yokes 46a and 46b and a gap 46h between the paired yokes 46c and 46d, respectively. The permanent magnets 49a and 49b are magnetized in the direction of the tube axis and held by ring-shaped magnetic material members 14a, 14b and 14c with the poles of the same polarity contacting to each other.

Figure 8:
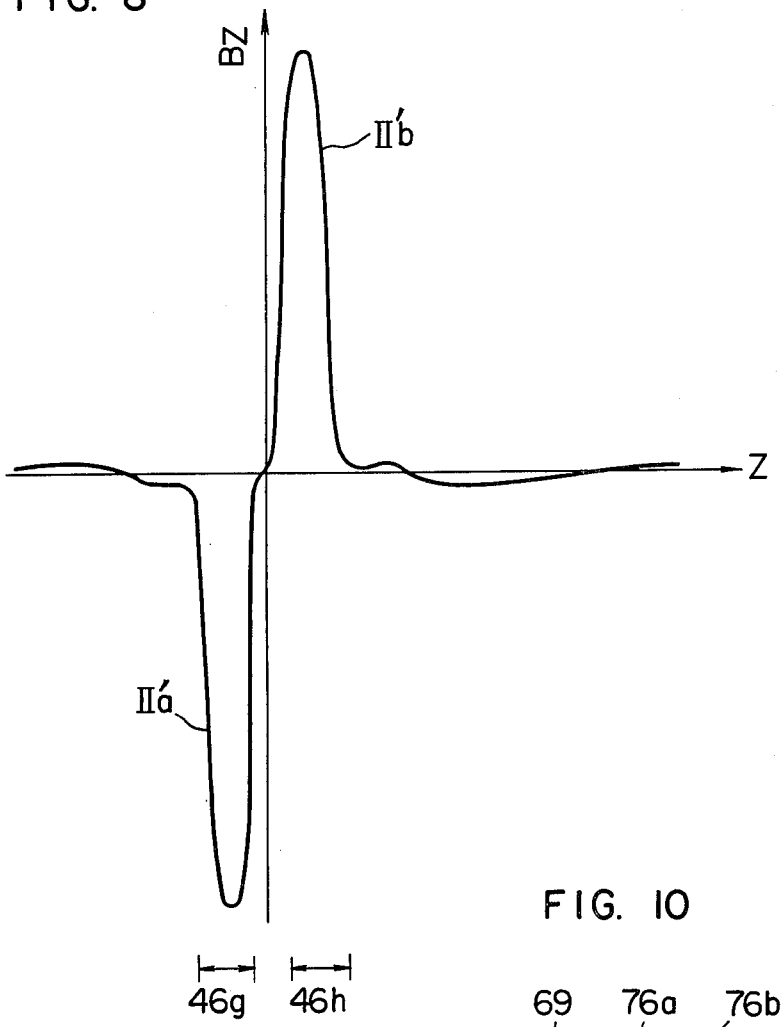
FIG. 8 shows a graph of an experimental data of the magnetic field component $B_Z$ on the tube axis in the embodiment of FIG. 6.

With the structure described above, a magnetic focusing field having its sense reverse to the travel direction of the electron beams 12a–12c is formed in the gap 46g between the paired yokes 46a and 46b as shown by broken lines in FIG. 5 and a magnetic focusing field having the same sense as the travel direction of the electron beams 12a–12c is formed in the gap 46h between the paired magnetic yokes 46c and 46d. As a result, a distribution of the magnetic field component $B_Z$ as shown in FIG. 8 is obtained among the magnetic yokes 46a–46d. More specifically, a magnetic focusing field shown by a curve II'*a* is formed between the yokes 46a and 46b, and a magnetic focusing field shown by a curve II'*b* is formed between the yokes 46c and 46d. Accordingly, a pair of magnetic lenses are formed in terms of those magnetic focusing fields in the gap 46g between the yokes 46a and 46b and the gap 46h between the yokes 46c and 46d. As a result, the focusing characteristic is greatly improved. In addition, since no substantial leakage magnetic field is produced on the cathode side of the yoke 46a and the phosphor screen side of the yoke 46d, the deterioration of the deflection characteristic and the convergence characteristic due to the leakage magnetic field is substantially suppressed.

One or more combination of the magnetic yoke pair and the permanent magnet may be added to the structure of FIG. 6. In this case, the direction of magnetization of the additional permanent magnet is opposite to that of the preceding nearest permanent magnet. When three such combinations of the magnetic yoke pair and the permanent magnet are used, it will be understood that a magnetic field distribution as shown in FIG. 5 is obtained.

In the magnetic field distributions shown in FIGS. 5 and 8, an integration of the components above the Z axis is substantially equal to an integration of the components below the Z axis.

Figure 9:
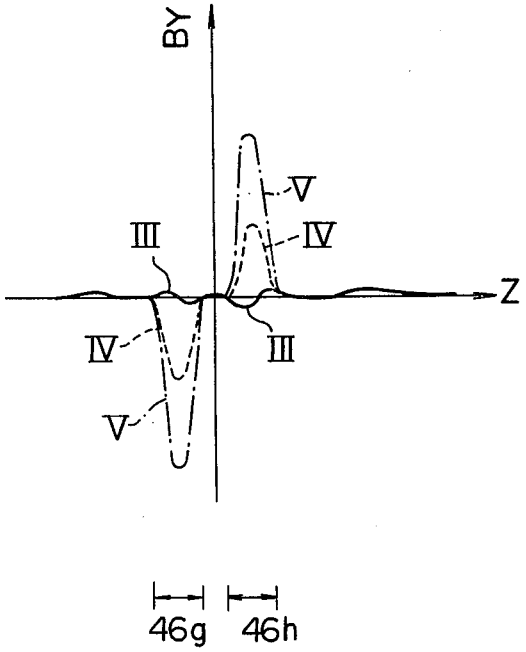
FIG. 9 shows a graph of an experimental data of a magnetic field component $B_Y$ on the side electron beam axis in the embodiment of FIG. 6.

A magnetic field $B_Y$ in the direction of Y axis shown in FIG. 7 on the axis of the side beam 12a or 12c was measured while shifting the permanent magnets 49a and 49b shown in FIG. 6 from the symmetrical adjacent position away from each other in the direction of the tube axis. The magnetic fields $B_Y$ created in the gaps 46g and 46h have opposite senses to each other as shown in FIG. 9. In FIG. 9, a curve III depicts a magnetic field created $B_Y$ when the center of the magnet 49a coincides with the center of the gap 46g and the center of the magnet 49b coincides with the center of the gap 46h and a curve IV a magnetic field $B_Y$ created when the magnets 49a and 49b are displaced away from each other by 1 mm in the direction of the tube axis, and a curve V a magnetic field $B_Y$ created when the magnets 49a and 49b are displaced in the same manner by 2 mm. As seen therefrom, since the magnetic field $B_Y$ appears above and below the Z axis with the same amount and opposite sense to each other such as $+B_Y$ and $-B_Y$, the displacements or shifts of the side beam 12a or 12c in the opposite directions on the Y axis normal to the Z axis are cancelled by each other. As a result, even when the permanent magnets 49a and 49b are displaced, the shift of the static convergence due to the shift of the side beam can be suppressed. The same effect is obtained in the structure of the embodiment of FIG. 4 because the distribution of the magnetic field $B_Y$ in the Y direction on the axis of the side beam 12a or 12c when the permanent magnet 29 in FIG. 4 is displaced is similar to the distribution of $B_Z$ in FIG. 5. In the prior art structure shown in FIG. 1, only unidirectional magnetic field component $B_Y$ appears when the permanent magnet 9 is displaced because only one gap 6g is present and hence the shift of the side beam is substantial. According to an experiment made by the present inventors, the shift of the static convergence when the permanent magnet 9 in the structure of FIG. 1 was displaced by 1 mm was 12 mm while the shift of the static convergence when the combination of the permanent magnets 49a and 49b in the structure of FIG. 6 were moved in the direction of the tube axis by 1 mm was 1 mm. Accordingly, the shift of the static convergence in the present structure is reduced by the factor of approximately ten over the prior art structure.

In accordance with the present inventors' experiments about the degree of the rotation of an image area or imaged picture on the phosphor screen due to the possible leakage magnetic field, it has been found that the conventional structure shown in FIG. 1 provides the rotation angle of 5° while, for example, the structure of the embodiment shown in FIG. 6 provides only 0.6°, the same inch tube being used for the both structures.

FIG. 10 shows a sectional view of a principal portion of an electromagnetic focusing cathode-ray tube according to a further embodiment of the present invention. When the structure shown in FIG. 10 is combined with the magnetic yokes 46a–46d shown in FIG. 6, it functions as an outer permanent magnet member. When it is mounted within the tube, it functions as an assembly which serves as both the permanent magnets 49a, 49b and the magnetic yokes 46a–46d shown in FIG. 6.

An example in which the structure of FIG. 10 is used as the outer permanent magnet member is explained below. Numeral 76a denotes a magnetic yoke for magnetic shunt made of soft ferromagnetic material. The yoke 76a has a rectangular-shaped cross section and cylindrical or ring-shaped outer profile. It has center openings 100 through which a neck portion of the bulb is to extend. Within the yoke 76a, a cylindrical permanent magnet 69 magnetized in a direction of the tube axis and a cylindrical or ring-shaped magnetic shunt plate 76b made of soft ferromagnetic material are fixedly mounted coaxially along the opening 100. The permanent magnet 69 and the magnetic shunt plate 76b have the substantially same diameter as the opening 100. In the illustrated embodiment, an S pole of the permanent magnet 69 is fixed to the magnetic yoke 76a while the magnetic shunt plate 76b is fixedly mounted to an N pole of the permanent magnet 69 to form a magnetic focusing field generating means. With the structure described above, an S magnetic pole is formed at opposite open ends of the magnetic yoke 76a and an N magnetic pole is formed at the magnetic shunt plate 76b in the magnetic yoke 76a so that the S-N-S magnetic pole arrangement is provided in the direction of the tube axis. The neck portion of the bulb is inserted into the openings 100 of the outer permanent magnet member and the bulb is positioned such that the center of the permanent magnet 69 aligns with the gap 46g and the midpoint between the magnetic shunt plate 76b and the open end of the yoke 76a on the side of the phosphor screen aligns with the gap 46h.

When the structure shown in FIG. 10 is mounted within the tube, the outer diameter of the magnetic yoke 76a should be selected to be smaller than the inner diameter of the neck portion of the bulb, and each of the openings 100 shown in FIG. 10 should be modified to an apertured form providing the beam permeable apertures 54a, 54b and 54c shown in FIG. 6. In this case, the outer permanent magnets 49a and 49b shown in FIG. 6 are not necessary. The apertured end of the yoke 76a on the side of the cathode and the magnetic shunt plate 76b serves as the yokes 46a and 46b of FIG. 6, respectively, while the magnetic shunt plate 76b and the apertured end of the yoke 76a on the side of the phosphor screen serve as the yokes 46c and 46d of FIG. 6, respectively.

FIG. 11 shows a sectional view of a principal portion of an electromagnetic focusing cathode-ray tube according to a still further embodiment of the present invention. In the present embodiment, a cylindrical or ring-shaped permanent magnet 89 magnetized in the direction normal to the tube axis is mounted at the center of the magnetic yoke 96a. An S pole of the permanent magnet is fixed to the inner wall of the yoke 96a and a cylindrical or ring-shaped magnetic shunt plate 96b is fixedly mounted to an N pole of the permanent magnet.

In this structure, an S magnetic pole is formed at opposite ends of the magnetic yoke 96a while an N magnetic pole is formed at the magnetic shunt plate 96b at the center of the magnetic yoke 96a so that the S-N-S magnetic pole arrangement is formed in the direction of Z axis. Portions 120 are used as openings to which the neck portion of the bulb is inserted when the structure of FIG. 11 is used as the outer permanent magnet member in a manner similar to that illustrated in FIG. 10. When the structure of FIG. 11 is mounted within the bulb 1 of the tube as illustrated, beam permeable apertures 54a, 54b and 54c are formed in the portions 120.

FIGS. 12a and 12b show modifications of the embodiment of FIG. 10. FIG. 12a shows a structure of N-S-N-S magnetic pole arrangement in the direction of tube axis and FIG. 12b shows a structure of S-N-S-N-S magnetic pole arrangement. The reason why those magnetic pole arrangements are obtained will be apparent from the drawings and hence is not explained here.

FIGS. 13a and 13b show modifications of the embodiment of FIG. 11. FIG. 13a shows a structure of S-N-S-N magnetic pole arrangement in the direction of the tube axis and FIG. 13b shows a structure of S-N-S-N-S magnetic pole arrangement.

Though the present invention has been explained above with reference to various embodiments thereof, an important feature of the present invention resides in that plural pairs of magnetic material members are disposed, the magnetic material members in each pair are disposed to oppose each other in a direction of the tube axis with a gap defined therebetween, and magnetic focusing fields having their senses opposite or reverse to each other in the direction of the tube axis are produced in the respective gaps associated with the adjacent magnetic material member pairs, so that the magnetic focusing fields by one or more permanent magnet are effectively formed in the respective gaps and the production of the leakage magnetic field is minimized. In this manner, the focusing characteristic is improved and the deterioration of the characteristics due to the leakage magnetic flux is suppressed.

What is claimed is:

1. An electromagnetic focusing cathode-ray tube comprising an electron gun assembly and a magnetic focusing field forming means including in combination a permanent magnet member disposed on an outer circumference of the tube and a magnetic material assembly disposed on one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to oppose each other in the direction of the tube axis with a gap defined therebetween, said permanent magnet member and said plural pairs of magnetic material members being arranged so that magnetic focusing fields having their senses reverse to each other in the direction of the tube axis are formed in the respective gaps associated with adjacent ones of said magnetic material member pairs, and adjacent magnetic material members of different oes of said magnetic material member pairs being directly coupled to each other so that magnetic fluxes emanated inwardly from said permanent magnet member are absorbed by said directly coupled magnetic material members.

2. An electromagnetic focusing cathode-ray tube according to claim 1, wherein said permanent magnet member is a cylindrical permanent magnet disposed on the outer circumference of said tube at a position corresponding to the gap associated with a selected one of said plural magnetic material member pairs and said permanent magnet is magnetized in the direction of the tube axis.

3. An electromagnetic focusing cathode-ray tube according to claim 2, wherein said plural magnetic material member pairs are odd in number and said selected pair is in the center pair.

4. An electromagnetic focusing cathode-ray tube according to claim 1, wherein said permanent magnet member comprises a combination of a plurality of cylindrical permanent magnets arranged on the outer periphery of said tube at positions corresponding to the respective gaps associated with said plural magnetic material member pairs, the adjacent permanent magnets being magnetized in opposite senses to each other in the direction of the tube axis.

5. An electromagnetic focusing cathode-ray tube according to claim 1, wherein said magnetic material member pairs are two in number, and said permanent magnet member comprises a cylindrical permanent magnet magnetized in the direction of the tube axis, a cylindrical magnetic shunt plate fixedly mounted to one magnetic pole of said permanent magnet and a cylindrical magnetic yoke having first and second open ends thereof opposing each other in the direction of the tube on opposite sides of said magnetic shunt plate, said first open end being fixedly mounted to the other magnetic pole of said permanent magnet, and the gap of one of said two pairs of magnetic material members being positioned to align a position between said first open end of said magnetic yoke and said magnetic shunt plate while the gap of the other pair of magnetic material members being positioned to align with a position between said second open end of said magnetic yoke and said magnetic shunt plate.

6. An electromagnetic focusing cathode-ray tube according to claim 1, wherein said magnetic material member pairs are two in number, and said permanent magnet member comprises a cylindrical permanent magnet magnetized normally to the tube axis, a cylindrical magnetic shunt plate fixed to an inner magnetic pole of said permanent magnet and a cylindrical magnetic yoke having first and second open ends thereof opposing to each other in the direction of the tube axis on the opposite sides of said magnetic shunt plate and a center portion thereof fixed to an outer magnetic pole of said permanent magnet, the gap of one of said two pairs of magnetic material members being positioned to align with a position between said first open end of said magnetic yoke and said magnetic shunt plate while the gap of the other pair of magnetic material members being positioned to align with a position between said second open end of said magnetic yoke and said magnetic shunt plate.

7. An electromagnetic focusing cathode-ray tube according to claim 1, wherein said directly coupled magnetic material members are arranged for absorbing the magnetic fluxes emanated inwardly from said permanent magnet member in the region of said directly coupled magnetic material members while permitting the magnetic fluxes from said permanent magnet member to emanate inwardly in the respective gaps associated with adjacent ones of said magnetic material member pairs.

8. An electromagnetic focusing cathode-ray tube comprising an electron gun assembly and a magnetic focusing field forming means including in combination a permanent magnet member and a magnetic material assembly disposed on one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to each other in the direction of the tube axis with a gap defined therebetween, and said permanent magnet member and said plural pairs of magnetic material members are arranged so that magnetic focusing fields having their senses reverse to each other in the direction of the tube axis are formed in the respective gaps associated with adjacent ones of said magnetic material member pairs, said permanent magnet member being arranged on an outer circumference of said tube, said permanent magnet member being a cylindrical permanent magnet disposed on the outer circumference of said tube at a position corresponding to the gap associated with a selected one of said plural magnetic material member pairs and said permanent magnet being magnetized in the direction of the tube axis.

9. An electromagnetic focusing cathode-ray tube according to claim 8, wherein said plural magnetic material member pairs are odd in number and said selected pair is the center pair.

10. An electromagnetic focusing cathode-ray tube comprising an electron gun assembly and a magnetic focusing field forming means including in combination a permanent magnet member and a magnetic material assembly disposed one one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to oppose each other in the direction of the tube axis with a gap defined therebetween, said permanent magnet member and said plural pairs of magnetic material members are arranged so that magnetic focusing fields having their senses reverse to each other in the direction of the tube axis are formed in the respective gaps associated with adjacent ones of said magnetic material member pairs, said permanent magnet member being arranged on an outer circumference of said tube, said permanent magnet member comprising a combination of a plurality of cylindrical permanent magnets arranged on the outer periphery of said tube at positions corresponding to the respective gaps associated with said plural magnetic material member pairs, the adjacent permanent magnets being magnetized in opposite senses to each other in the direction of the tube axis.

11. An electromagnetic focusing cathode-ray tube comprising an electron gun assembly and a magnetic focusing field forming means including in combination a permanent magnet member and a magnetic material assembly disposed on one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to oppose each other in the direction of the tube axis with a gap defined therebetween, and said permanent magnet member and said plural pairs of magnetic material members are arranged so that magnetic focusing fields having their senses reverse to each other in the direction of the tube axis are formed in the respective gaps associated with adjacent ones of said magnetic material member pairs, said permanent magnet member being arranged on an outer circumference of said tube, said magnetic material member pairs being two in number, and said permanent magnet member comprising a cylindrical permanent magnet magnetized in the direction of the tube axis, a cylindrical magnetic shunt plate fixedly mounted to one magnetic pole of said permanent magnet and a cylindrical magnetic yoke having first and second open ends thereof opposing each other in the direction of the tube on opposite sides of said magnetic shunt plate, said first open end being fixedly mounted to the other magnetic pole of said permanent magnet, and the gap of one of said two pairs of magnetic material members being positioned to align a position between said first open end of said magnetic yoke and said magnetic shunt plate while the gap of the other pair of magnetic material members being positioned to align with a position between said second open end of said magnetic yoke and said magnetic shunt plate.

12. An electromagnetic focusing cathode-ray tube comprising an electron gun assembly and a magnetic focusing field forming means including in combination a permanent magnet member and a magnetic material assembly disposed on one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to oppose each other in the direction of the tube axis with a gap defined therebetween, and said permanent magnet member and said plural pairs of magnetic material members are arranged so that magnetic focusing fields having their senses reverse to each other in the direction of the tube axis are formed in the respective gaps associated with adjacent ones of said magnetic material member pairs, said permanent magnet member being arranged on an outer circumference of said tube, said magnetic material member pairs being two in number, and said permanent magnet member comprising a cylindrical permanent magnet magnetized normally to the tube axis, a cylindrical magnetic shunt plate fixed to an inner magnetic pole of said permanent magnet and a cylindrical magnetic yoke having first and second open ends thereof opposing to each other in the direction of the tube axis on the opposite sides of said magnetic shunt plate and a center portion thereof fixed to an outer magnetic pole of said permanent magnet, the gap of one of said two pairs of magnetic material members being positioned to align with a position between said first open end of said magnetic yoke and said magnetic shunt plate while the gap of the other pair of magnetic material members being positioned to align with a position between said second open end of said magnetic yoke and said magnetic shunt plate.

13. An electromagnetic focusing cathode-ray tube comprising an electron gun assembly and a magnetic focusing field forming means including in combination a permanent magnet member and a magnetic material assembly disposed on one side of said electron gun assembly within the tube, said magnetic material assembly having a plurality of electron beam permeable apertures, each aperture extending in a direction of the tube axis, wherein said magnetic material assembly includes plural pairs of magnetic material members, the magnetic material members in each pair being disposed to oppose each other in the direction of the tube axis with a gap defined therebetween, and said permanent magnet member and said plural pairs of magnetic material members are arranged so that magnetic focusing fields having their senses reverse to each other in the direction of the tube axis are formed in the respective gaps associated with adjacent ones of said magnetic material member pairs, said permanent magnet member being a cylindrical permanent magnet arranged within the tube and having an inner diameter not smaller than a diameter of a sectional area containing said plurality of electron beam permeable apertures of said magnetic material assembly.

14. An electromagnetic focusing cathode-ray tube according to claim 13, wherein said permanent magnet is magnetized in the direction of the tube axis, and said magnetic material assembly comprises a cylindrical magnetic shunt plate fixed to one magnetic pole of said permanent magnet and a cylindrical magnetic yoke having first and second apertured ends thereof opposing each other in the direction of the tube axis on the opposite sides of said magnetic shunt plate, said first apertured end being fixed to the other magnetic pole of said permanent magnet, whereby the combination of said first apertured end of said magnetic yoke and said magnetic shunt plate and the combination of said second apertured end of said magnetic yoke and said magnetic shunt plate provide two pairs of said magnetic material member pairs.

15. An electromagnetic focusing cathode-ray tube according to claim 13, wherein said permanent magnet is magnetized normally to the tube axis, and said magnetic material assembly comprises a cylindrical magnetic shunt plate fixed to an inner magnetic pole of said permanent magnet and a cylindrical magnetic yoke having first and second apertured ends thereof opposing each other in the direction of the tube axis on the opposite sides of said magnetic shunt plate and a center portion thereof fixed to an outer magnetic pole of said permanent magnet, whereby the combination of said first apertured end of said magnetic yoke and said magnetic shunt plate and the combination of said second apertured end of said magnetic yoke and said magnetic shunt plate provide two pairs of said magnetic material member pairs.

* * * * *